US007047988B2

(12) United States Patent
Schwartz

(10) Patent No.: US 7,047,988 B2
(45) Date of Patent: May 23, 2006

(54) AUTOMATIC CLEANING MECHANISM FOR A PAINT SPRAYER

(76) Inventor: Sharon Schwartz, 10018 Spanish Isles Blvd., Suite A-49, Boca Raton, FL (US) 33498

( * ) Notice: Subject to any disclaimer, the term of this patent is extended or adjusted under 35 U.S.C. 154(b) by 142 days.

(21) Appl. No.: 10/023,570

(22) Filed: Dec. 17, 2001

(65) Prior Publication Data

US 2002/0074024 A1 Jun. 20, 2002

Related U.S. Application Data

(60) Provisional application No. 60/256,626, filed on Dec. 18, 2000.

(51) Int. Cl.
*B08B 3/02* (2006.01)

(52) U.S. Cl. ..... 134/170; 134/167 R; 134/171; 134/198

(58) Field of Classification Search ..... 118/167 R, 118/168 R, 169 R, 169 A, 170, 171, 172, 118/198, 199, 300, 302

See application file for complete search history.

(56) References Cited

U.S. PATENT DOCUMENTS

| | | | | |
|---|---|---|---|---|
| 3,771,539 | A * | 11/1973 | De Santis | 134/111 |
| 4,025,363 | A * | 5/1977 | De Santis | 134/102.2 |
| 4,784,170 | A * | 11/1988 | Romanelli et al. | 134/113 |
| 5,220,933 | A * | 6/1993 | Albers | 134/58 R |
| 5,485,860 | A * | 1/1996 | Robb et al. | 134/166 C |
| 5,937,875 | A * | 8/1999 | Nygren | 134/22.11 |
| 6,554,009 | B1 * | 4/2003 | Beijbom et al. | 134/95.3 |

* cited by examiner

*Primary Examiner*—Joseph L. Perrin
(74) *Attorney, Agent, or Firm*—John C. Smith

(57) ABSTRACT

A cleaning device which washes each of the components of a paint sprayer from the correct angle to ensure that all residue is properly removed. The invention provides a mechanism for aligning cleaning nozzles with the components of the paint sprayer. Holding devices precisely position components of the paint sprayer such that they align the components to be cleaned with adapters happening solvent spray nozzles. Each holding device is aligned with individual spray nozzles that spray cleaning fluid onto surfaces from which paint is to be removed. Adjustable spray nozzles are provided which allow the cleaning device to be adjusted such that the it can be used with paint sprayers having different configurations. An alternative embodiment provides a kit assembly that can be retrofitted to a conventional cleaning machine. Alternatively, the device may be used with other tools which are disassembled prior to cleaning.

20 Claims, 15 Drawing Sheets

AUTOMATIC CLEANING MECHANISM FOR A PAINT SPRAYER

CROSS REFERENCE TO RELATED APPLICATIONS

This application is a non-provisional application which claims the benefit of the commonly owned copending application entitled "Automatic Cleaning Mechanism for a Paint Sprayer", filed Dec. 18, 2000, bearing U.S. Ser. No. 60/256,626 and naming Sharon Schwartz, the named inventor herein, as sole inventor, the contents of which is specifically incorporated by reference herein in its entirety.

TECHNICAL FIELD

The present invention relates to cleaning devices. In particular, it relates to an automatic cleaning assembly in which individual components of a paint sprayer are simultaneously cleaned.

BACKGROUND

Spraying devices have been designed for a number of applications for the purpose of increasing the ability to rapidly and uniformly apply liquids to a variety of surfaces. One important application for which sprayers have proved valuable is their use by painters. Prior art devices such as paint rollers and brushes take substantially more time to cover a given unit of surface area than do paint spraying systems. In addition, paint sprayers are able to provide a more uniformed distribution of paint on a given surface. As a result, paint sprayers have enjoyed widespread use in the painting industry.

One problem associated with the use of paint sprayers is the amount of time and effort required to properly clean a paint sprayer nozzle. Due to the amount of time required to properly clean a paint sprayer nozzle, some of the benefit of using it in place of prior art painting devices is lost. It would be desirable to have a method of rapidly cleaning paint sprayer nozzles to reduce the amount of turnaround time between paint jobs.

In an effort to improve turnaround time, cleaning chambers were developed to reduce the amount of time required to clean a paint sprayer nozzle. Prior art cleaning chambers are typically metal chambers which have a series of solvent sprayers arranged in the corner of the chamber. In practice, a paint sprayer nozzle is disassembled, placed in the chamber, and then sprayed with a solvent which dissolves any paint residue to prepare the paint sprayer nozzle for use with another paint. A problem associated with this type of cleaning chamber is that it is designed for general purpose use with paint sprayers as well as any number of other devices that can be cleaned with solvent. Because of their general-purpose nature, these are cleaning chambers are not designed to clean a paint sprayer nozzle in the most efficient manner, but rather to provide a device for cleaning a variety of objects. Of course, when paint colors are changed, the presence of paint from a previous job can result in distortions in the color of the subsequent job.

Because residue paint having one paint color can have a disastrous effect when the paint sprayer nozzle is used to paint with a different paint color, a paint sprayer nozzle must be meticulously cleaned to ensure that all traces of the previously used paint are removed. Unfortunately, the general purpose cleaning chambers used in the prior art are not capable of adequately cleaning a complex mechanical structure such as a paint sprayer nozzle.

In addition to distortion of color caused by paint residue of one color mixing with new paint having any second color, paint residue can cause other severe problems. For example, when paint residue builds up in a paint nozzle, it may distort the spray pattern of the paint nozzle, resulting in uneven distribution of paint from the sprayer which will result in an unsatisfactory paint job which may have to be redone. As a result, it is very important to ensure that the components of the paint sprayer are carefully and thoroughly cleaned to avoid defective paint jobs caused by dry paint residue.

While addressing the basic desirability of cleaning paint sprayer nozzles between uses, the prior art has failed to provide a cleaning device which can be adjusted to clean each individual part in a paint sprayer, which can be retrofitted to pre-existing sprayers, and which has a minimum number of components.

SUMMARY OF THE INVENTION

The present invention provides a cleaning device which automatically aligns each of the components of a paint sprayer to the correct angle to ensure that all residue is properly removed. The invention provides a mechanism for aligning cleaning nozzles with the components of the paint sprayer. The mechanism precisely positions components of the paint sprayer in holding devices inside a cleaning machine with the paint sprayer components such that they can be automatically cleaned by a cleaning assembly aligned with the holding devices. Each holding device is aligned with individual spray nozzles that spray cleaning fluid onto surfaces from which paint is to be removed. Adjustable spray nozzles are provided which allow the cleaning device to be adjusted such that the it can be used with paint sprayers having different configurations. An alternative embodiment provides a kit assembly that can be retrofitted to a conventional cleaning machine. Alternatively, the device may be used with other tools which are disassembled prior to cleaning.

BRIEF DESCRIPTION OF THE DRAWINGS

FIG. 10 illustrates a first assembly with holding devices aligned with cleaning nozzles for removable components of the paint sprayer.

FIG. 11 illustrates a second assembly of the alternative preferred embodiment of FIG. 10 which holds a canister lid in alignment with the associated cleaning nozzles.

FIG. 12 illustrates a third assembly for the alternative preferred embodiment of FIG. 10 which secures the canister and which aligns the cleaning nozzle with the canister.

FIG. 13 illustrates a fourth assembly for the alternative preferred embodiment of FIG. 10 which secures the sprayer body in alignment with the cleaning nozzle.

DESCRIPTION OF THE PREFERRED EMBODIMENT

Figure 1:
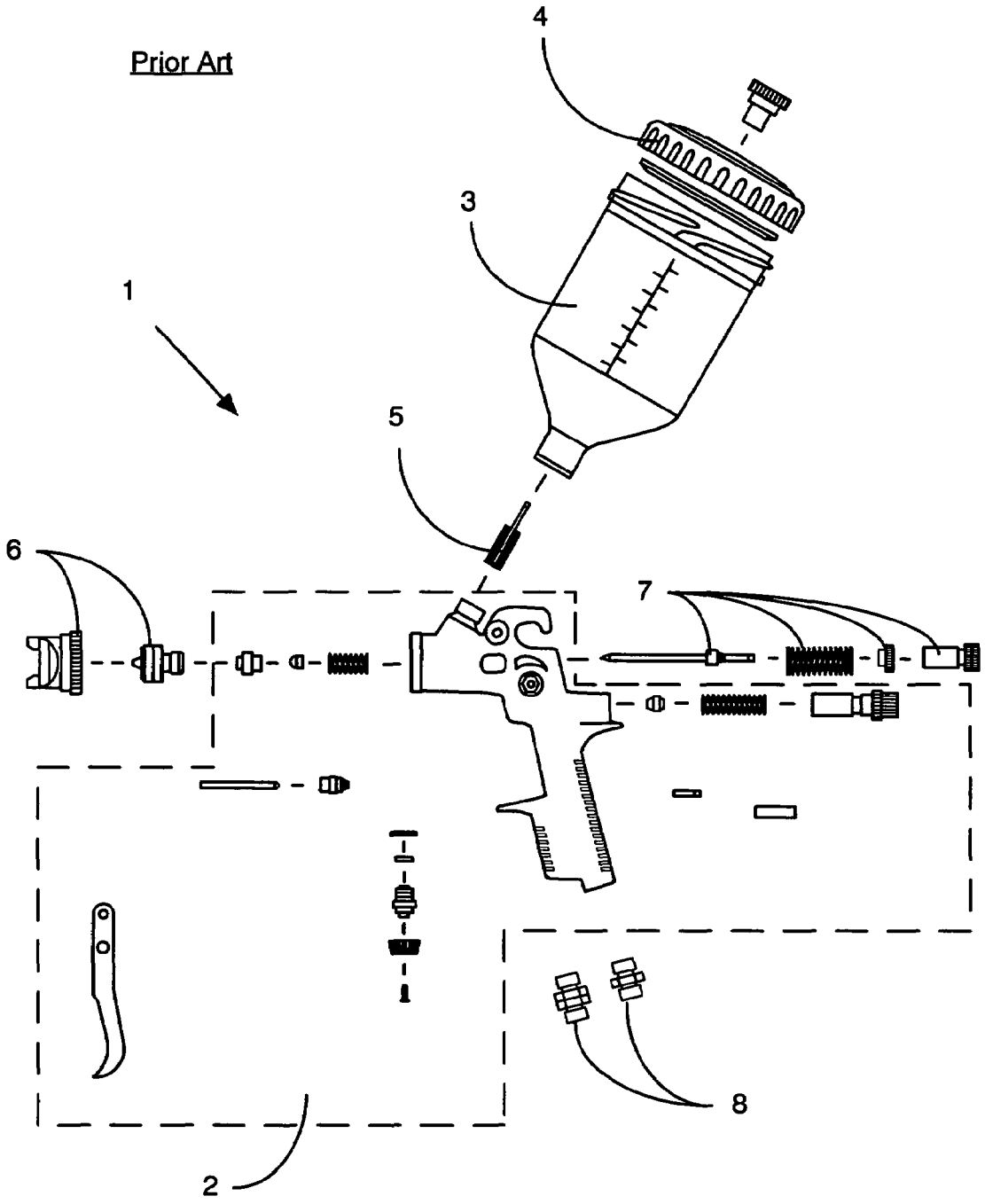
FIG. 1 is an exploded view of a conventional gravity fed paint sprayer.

Prior to a detailed discussion of the figures, a general overview of the device and its method of use will be presented. The cleaning device presented herein is designed to achieve several goals when using cleaning fluids, solvents, etc. For ease of discussion, the term solvent will be used throughout this specification. However, as used herein, the term "solvent" is intended to mean any type of cleaning fluid which may vary depending on the nature of the item to be cleaned. Likewise, for ease of discussion, the term "flexible" is used in conjunction with the extension tube. However, while the extension tube is discussed as being flexible, it is understood that the term flexible, as used herein, is intended to mean having the ability to move so as to permit alignment of the cleaning nozzles with the holding devices. Therefore, the term is intended to include rigid tubes which are movable as the result of having hinged arms, etc., as well as tubes which are flexible in the strict definition of the word.

One goal of the invention is to minimize contact of a user's skin with caustic fluids such as those used to dissolve paint. Another goal is to make the cleaning process more efficient by reducing the amount of time taken from the user to complete the cleaning process by semi-automating the cleaning process. Yet another goal is to improve the quality of the cleaning process by properly aligning the cleaning nozzles with the components of the paint sprayer such that paint residue from a prior paint job is completely removed prior to using the paint sprayer for a subsequent paint jobs.

The use of devices such as paint sprayers has greatly simplified the process of painting many items, including cars, houses, furniture, etc. However, while the painting process has been simplified, the amount of work required to clean residue from a paint sprayer after the painting is done has been increased due to the complicated nature of a typical paint sprayer. The use of chemical fluids has helped to eliminate paint residue in an efficient manner. However, the chemical solvency used for paint removal are caustic in nature, sometimes carcinogenic, and are preferably undesirable for direct contact with human skin, or ingestion via breathing.

Conventional cleaning devices require that the user spend substantial amounts of time cleaning each of the small components within a sprayer. Attempts to correct this have resulted in the development of spraying machines. A user will disassemble a sprayer, and then place the components in a spraying machine. Unfortunately, the random method in which a user lays the components of a disassembled sprayer will usually result in several of the components not being properly cleaned. As a result, the user must then carefully examine each component to see if it needs additional cleaning, it after. Each component that requires additional cleaning must then be re-cleaned.

This process creates several problems. First, it increases the amount of time that the user is in contact with the caustic fluids used to clean the paint sprayer. This is a safety problem for the user since the caustic fluids used to clean the paint sprayer may eventually create serious health side effects for the user if the user comes in frequent contact with it. Second, when the user has to repeat the cleaning process in order to ensure that the paint sprayer is properly cleaned, the user becomes less efficient because the time wasted cleaning the paint sprayer could have been used on more profitable activities.

The invention solves these problems by minimizing the amount of time in which a user is in contact with the fluid used to clean the paint sprayer, and by more properly cleaning the paint sprayer the first time without requiring a second cleaning operation. The time in which the user is in contact with the fluid is reduced since the user can place the components of the paint sprayer in mounting devices that hold the components of the paint sprayer in alignment with spray heads inside the cleaning machine, and then the user can close the cleaning machine and pursue other activities while the paint sprayer is being cleaned.

The cleaning system provided by this invention uses a conventional cleaning machine which typically comes with several machine sprayers, usually three, in each corner of the machine. In addition to the machine, the invention provides holding devices which are specifically designed to hold the various components of a paint sprayer. Each holding device is designed to position a specific component of the paint sprayer in alignment with a nozzle that sprays cleaning fluid. In addition to the holding devices, the invention includes a nozzle system which: 1) replaces the corner nozzles in a conventional cleaning machine if the invention is manufactured with the cleaning machine, or 2) attaches to, in the form of a kit, the preexisting nozzles on conventional cleaning machines. The nozzle system preferably has flexible tubing to allow it to be adjusted in relation to the holding devices to ensure the most effective cleaning. The control of the application of the cleaning fluid to specific locations within a paint sprayer minimize the time it takes to clean the paint sprayer, and further reduces required time by eliminating the need for a follow-up cleaning. The cleaning nozzles are preferably designed to be adjustable to allow them to be aligned with the paint sprayers. By aligning the cleaning nozzles with the apertures in the paint sprayers through which paint is moved, the cleaning solvents is better able to feed through the conduits within a paint sprayer which results in a more thorough paint job.

The user begins the cleaning process by disassembling the paint sprayer and inserting the various components in the device holders. The user then closes the cleaning device and begins the cleaning process. Cleaning machines of this type typically have lids to minimize contact of the cleaning fluid with the user's skin and also minimize ingestion of vapors.

In addition to improving the user's safety, the system also makes the user more efficient since the extra time normally taken to clean the paint sprayer has been eliminated due to the more efficient cleaning process which is completed unattended by the user.

Those skilled in the art will recognize that while paint sprayers are used as the device which is cleaned by the invention, the principles of the invention can also be used for any complex mechanical device which requires cleaning by fluids. We turn now to a detailed discussion of the figures.

FIG. 1 is an exploded view of a conventional paint sprayer 1 that illustrates the numerous components contained within it. The paint sprayer 1 contains several components which are required to be cleaned after each job. The paint sprayer body 2 is similar to a pistol in appearance. It also includes several other components as indicated by the dashed lines defining the box labeled 18. The paint sprayer body 2 has several openings through which paint flows during use. Due to the variety of paths in the paint sprayer body 2 which need to be cleaned, the placement of the paint sprayer body 2 is very important to ensure its proper cleaning. Merely placing it in a conventional cleaning machine typically results in an improper cleaning since the cleaning fluid may not enter the numerous apertures in the paint sprayer body 2 which need to be cleaned.

Another major component which requires cleaning is the paint canister 3. Paint canister 3 typically comes with a removable lid 4. The paint canister 3 and the removable lid 4 are attached to one another, and paint canister 3 is in turn attached to paint sprayer body 2 via an input paint filter 5. During normal operation, the paint flows from the paint canister 3 through input paint filter 5 to paint sprayer body 2. The paint proceeds from the paint sprayer body 2 through output nozzle assembly 6 to the ultimate painting surface. Each item in the output nozzle assembly 6 must be thoroughly cleaned after each use, along with the paint sprayer body 2, the paint canister 3, and the removable lid 4 which attaches to canister 3.

Also shown are spring loaded flow adjustment components 7. The each of the spring loaded flow adjustment components 7 must also be cleaned after each spray paint job.

As can be seen from the foregoing discussion, a paint sprayer 1 is a complicated mechanical device which requires substantial effort, time and care to be properly cleaned. Those skilled in the art will recognize the embodiment of FIG. 1 as a gravity fed paint sprayer 1. Alternative types of paint sprayers 1 will be discussed below.

Figure 2:
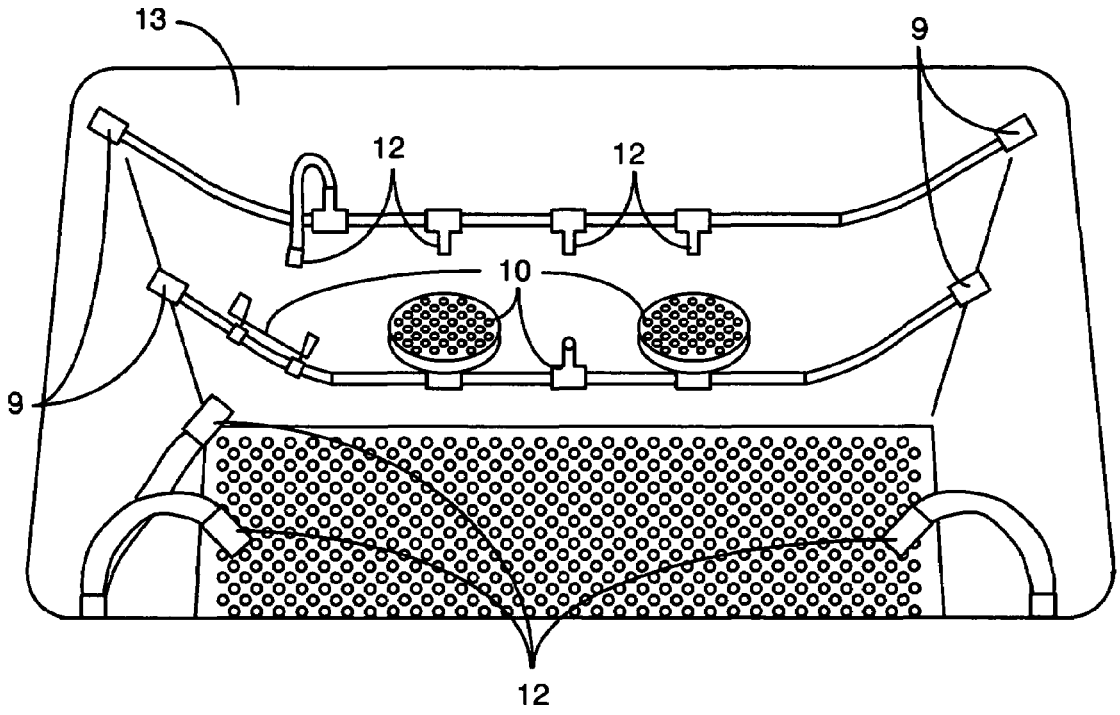
FIG. 2 illustrates the cleaning device prior to being loaded with the components of the paint sprayer.

FIG. 2 illustrates a conventional cleaning machine 13 which has machine sprayers 9 extending from the corners of the cleaning machine 13. These machine sprayers 9 are used as supply nozzles by the invention. In addition to the prior art cleaning machine 13, the additional features which comprise the invention are also shown in this figure. Holding devices 10 are shown installed at selected locations within cleaning machine 13. Likewise cleaning fluid extension tubes 11 are shown attached to machine sprayers 9 at their proximal end. The extension tubes 11 have nozzles 12 which are aligned with holding devices 10. The nozzles 12 and holding devices 10 are aligned such that when the components of a paint sprayer 1 are placed in holding devices 10, the nozzles 12 are pointed directly at the surfaces or apertures which require cleaning.

Those skilled in the art will recognize that holding devices 10, extension tubes 11 and nozzles 12 can be fabricated from any suitable material. Preferably, the extension tubes 11 are fabricated from flexible material, such as flexible pipe, which will allow their position to be adjusted. This will assist the user when aligning components of the invention for use with different types or configurations of paint sprayers 1.

Figure 3:
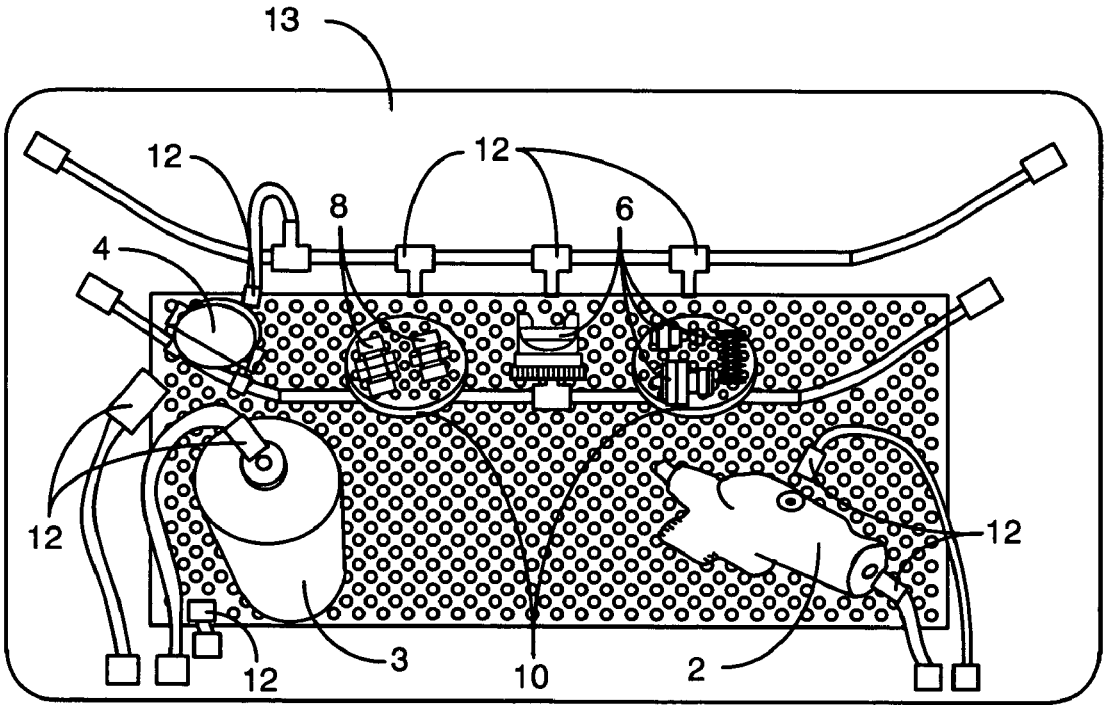
FIG. 3 is illustrating the cleaning device after being loaded with the components of the paint sprayer.

FIG. 3 illustrates the invention with the components of a disassembled paint sprayer 1 mounted in their respective holding devices 10. In particular, paint canister 3 is shown mounted on top of holding device 10. In this configuration one cleaning nozzle 12 (not shown) sprays upward inside of paint canister 3, while a second nozzle 12 sprays downward onto paint canister 3. Removable lid 4 is also shown held in position by a holding device 10 while it is being sprayed on both sides by cleaning nozzles 12. The components of output nozzle assembly 6 and input nozzle 8 are shown resting in holding devices 10 with cleaning nozzles 12 aligned with their corresponding holding devices 10. Also shown is sprayer body 2 mounted on its respective holding device 10 in alignment with corresponding nozzles 12.

In the preferred embodiment, cleaning nozzles 12 are directed to both sides of the components of the paint sprayer. In some instances, the components can rest on top of a cleaning nozzle 12 and be sprayed from below while simultaneously sprayed from above.

In operation, the user would merely disassemble the paint sprayer 1 and mount its components in their corresponding holding devices 10. The user would then close lid of cleaning machine 13 and turn on the system. By aligning the nozzles 12 with the components of paint sprayer 1 in the cleaning machine 13, the cleaning machine 13 operates at maximum efficiency and more effectively cleans the paint sprayer 1.

Figure 4:
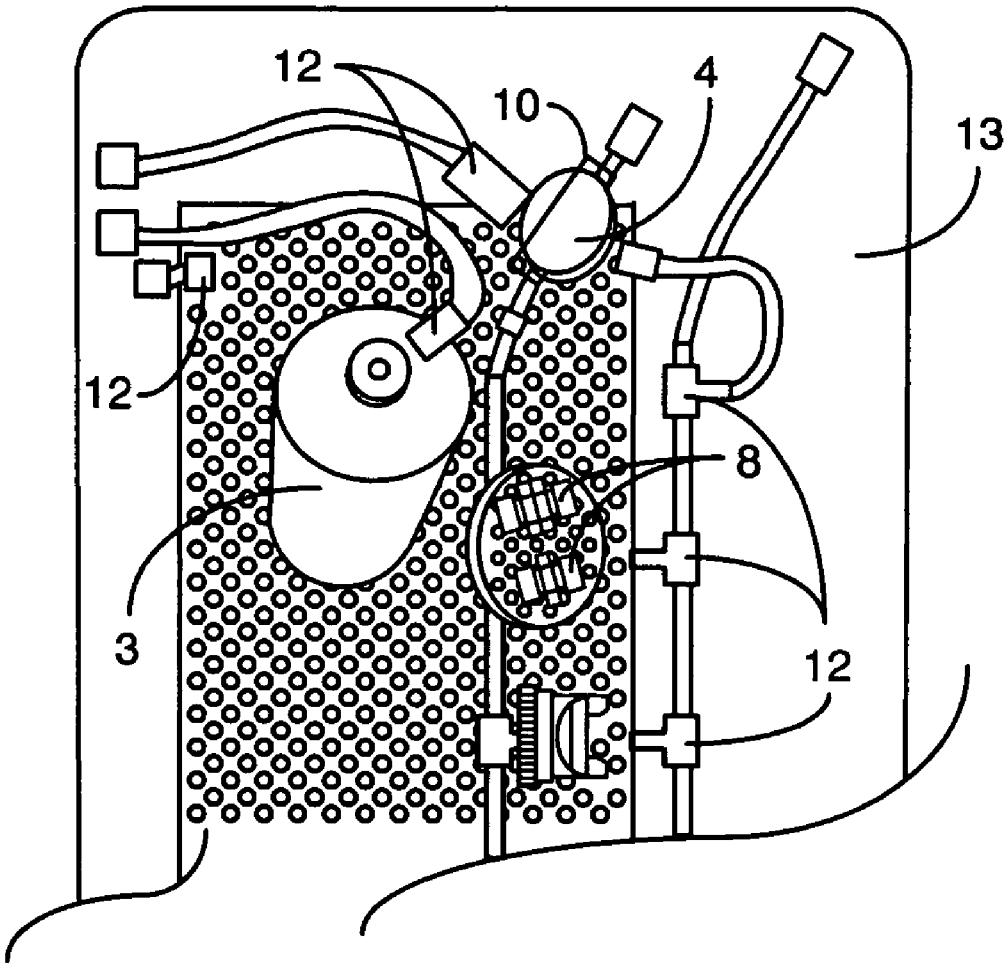
FIG. 4 is illustrating a close-up view of a paint canister held in position adjacent the paint canister cleaning sprayer. Also shown is the paint canister lid in a lid mounting assembly adjacent the lid cleaning sprayers.

FIG. 4 is a close up view of a portion of the embodiment of FIG. 3. In this view, the paint canister 3 is more clearly shown mounted on its holding device 10. Also shown is the nozzle 12 aligned with the paint canister 3. The removable lid 4 is shown mounted in a holding device 10 with its corresponding nozzle 12 aligned with it.

Figure 5:
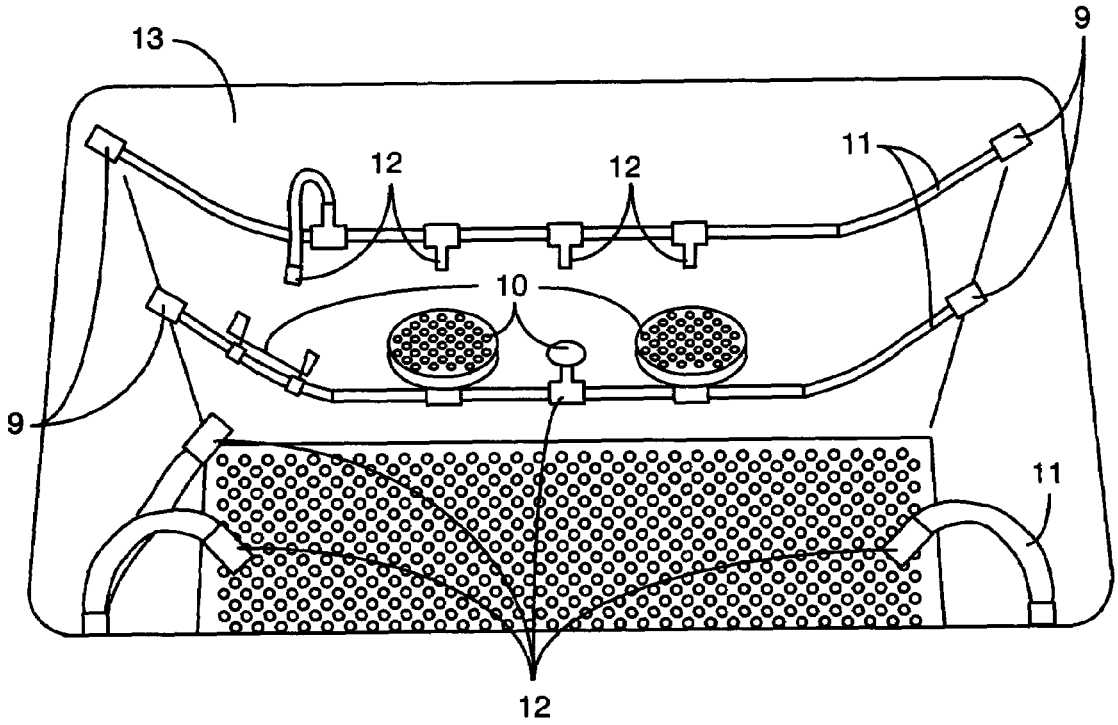
FIG. 5 illustrates a close-up view of retaining assemblies which hold the components on the output nozzle assembly and the spring loaded nozzle adjustment assembly.

In FIG. 5, nozzles 12 are shown aligned with holding devices 10. The nozzles 12 are shown attached to fluid extension tubes 11 which are in turn attached to sprayer nozzles 9. For ease of discussion, nozzles 9, which are present in prior art cleaning machines 13, can be deleted altogether by direct attachment of the extension tubes 11 to the manifold of the cleaning machine 13 which supplies the solvent.

Figure 6A:
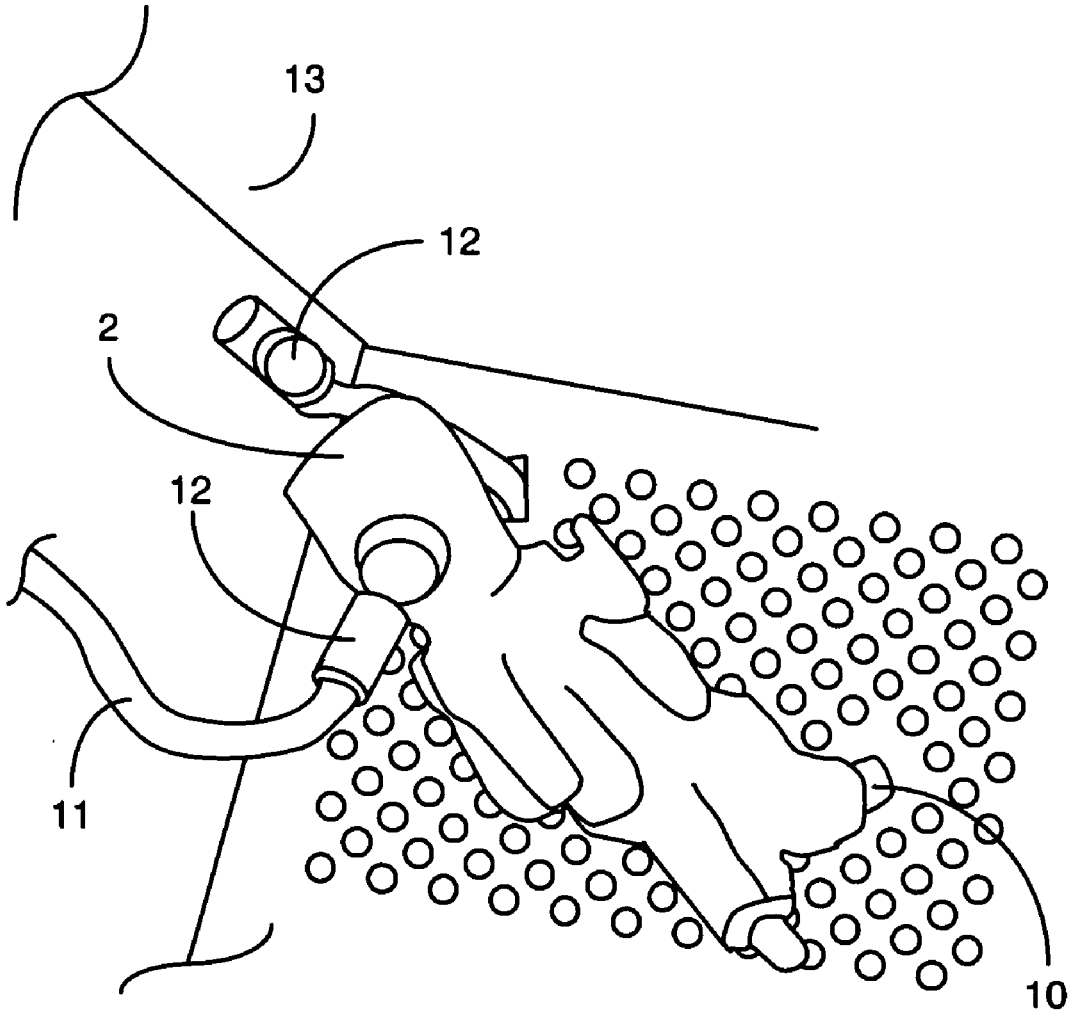
FIG. 6A illustrates a close-up view of the sprayer body in alignment with the body cleaning sprayers.

FIG. 6A is a close of view of the paint sprayer body 2 held by holding device 10 in alignment with nozzles 12. This alignment allows the nozzles 12 to sprayer cleaning fluid directly into the appropriate apertures of paint sprayer body 2. By aligning nozzles 12 in this manner, the areas most in need of cleaning receive a directed flow of cleaning fluid to the controlled application of cleaning fluid provided by the holding devices 10 and the nozzles 12.

Figure 6B:
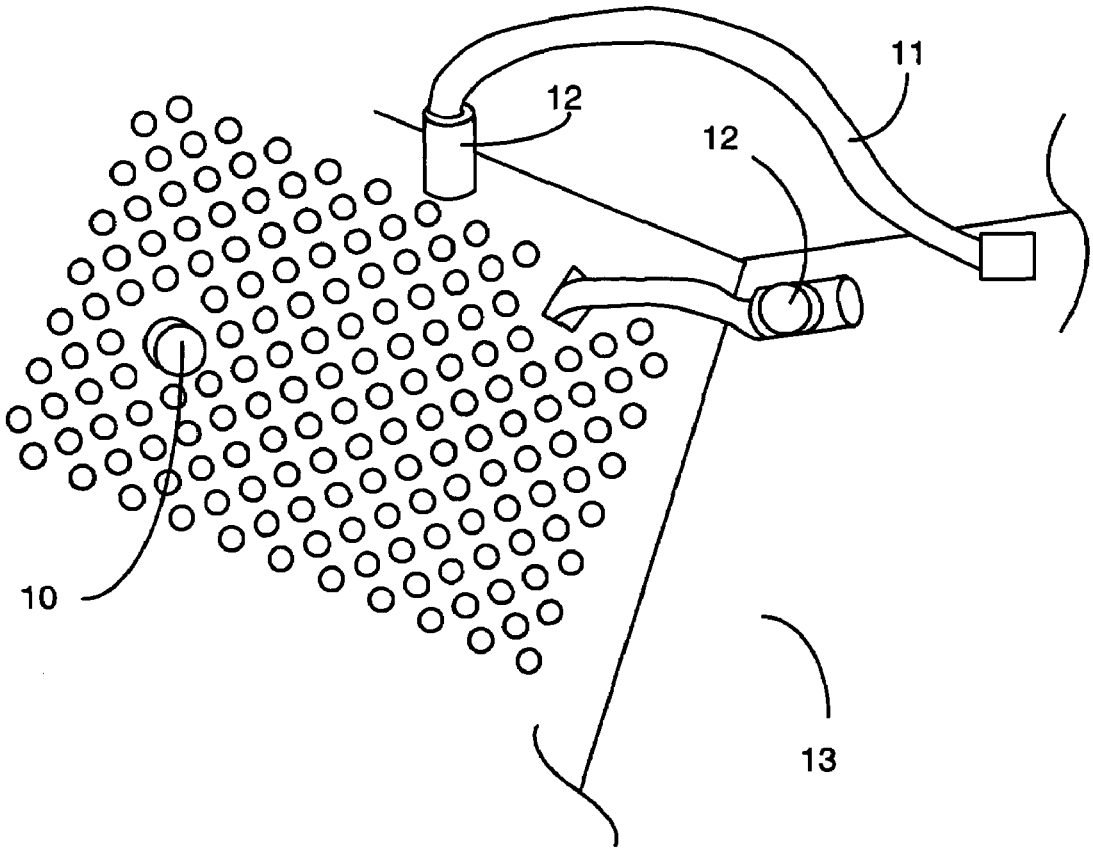
FIG. 6B illustrates a close-up view of the cleaning machine showing the holding device for the sprayer body when the sprayer body is not in the cleaning machine.

FIG. 6B is a close up view of the cleaning machine 13 with the sprayer body 2 removed. This view of illustrates her the holding device 10 which attaches to the bottom of the paint sprayer body 2 during the cleaning process. Those skilled in the art win recognize that the holding devices 10 can take any suitable form so long as they accomplish the objective of holding the components of the paint sprayer 1 in alignment with the nozzles 12 to ensure proper cleaning.

Figure 6C:
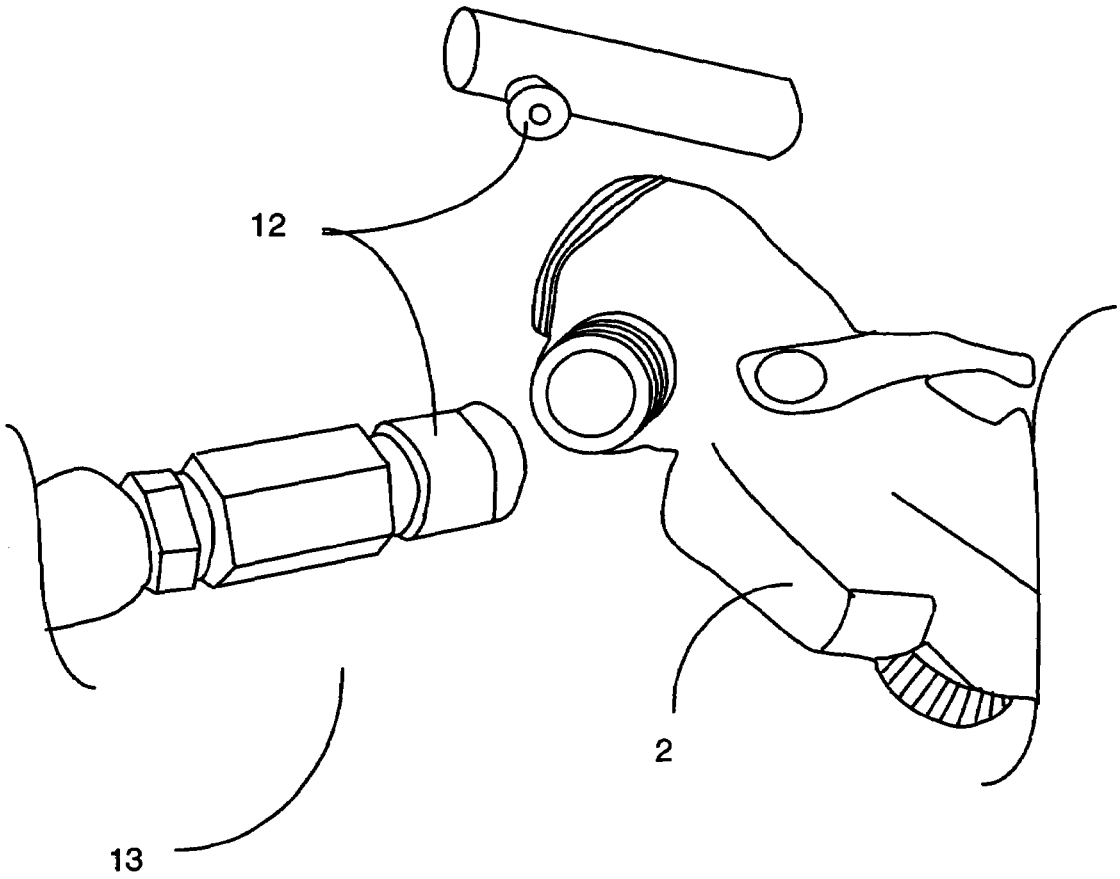
FIG. 6C is a close-up view of cleaning nozzles in close alignment with apertures on the paint sprayer body.

FIG. 6C illustrates a close-up view of cleaning nozzles in close alignment with apertures on the paint sprayer body. As can be seen, when the paint sprayer body are properly mounted on holding device 10, the nozzles 12 are in proper alignment with the apertures on the paint sprayer body 2 which results in the most thorough and effective cleaning of the paint sprayer body 2.

Figure 7:
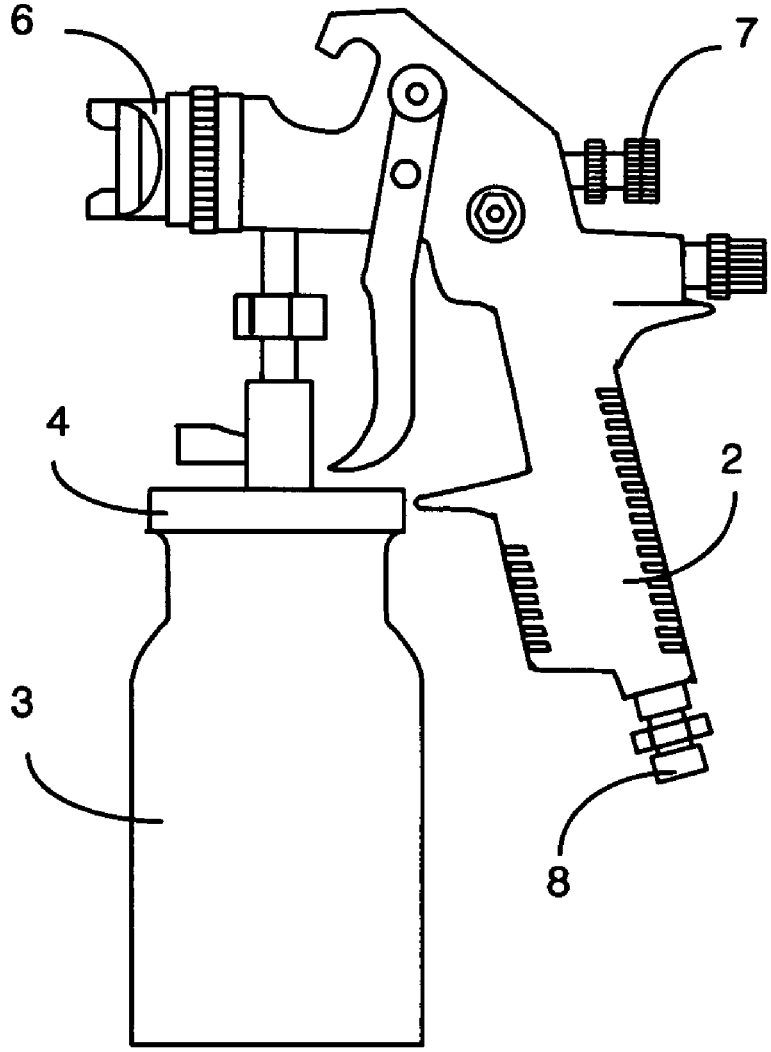
Figure 7 Prior Art
FIG. 7 is a diagram of an alternative embodiment of a car paint sprayer which uses a syphon feed paint canister rather than the gravity fed canister of FIG. 1.

In FIG. 7, an alternative embodiment of paint sprayer 1 is shown. In this embodiment, the paint canister 3 is mounted below the paint sprayer body 2. This configuration is commonly referred to as a syphon feed paint sprayer. An advantage of the invention is that it allows paint sprayers with different configurations to be cleaned by the same cleaning device. In this case, a holding device 10 (not shown in this figure) would retain the paint sprayer body 2 in the same fashion. The fluid extension tubes 11 would be moved to line with the apertures in this particular type of paint sprayer body 2 to provide the same cleaning efficiency. In addition, in an environment where multiple types of paint sprayer bodies 2 are used, an alternative method to realigning the fluid extension tubes 11 would be to have picture fluid extension tubes 11 pointing to all possible apertures on any type of paint sprayer body 2. This will allow the fluid extension tubes 11 and their associated nozzles 12 to be aligned once.

Figure 8:
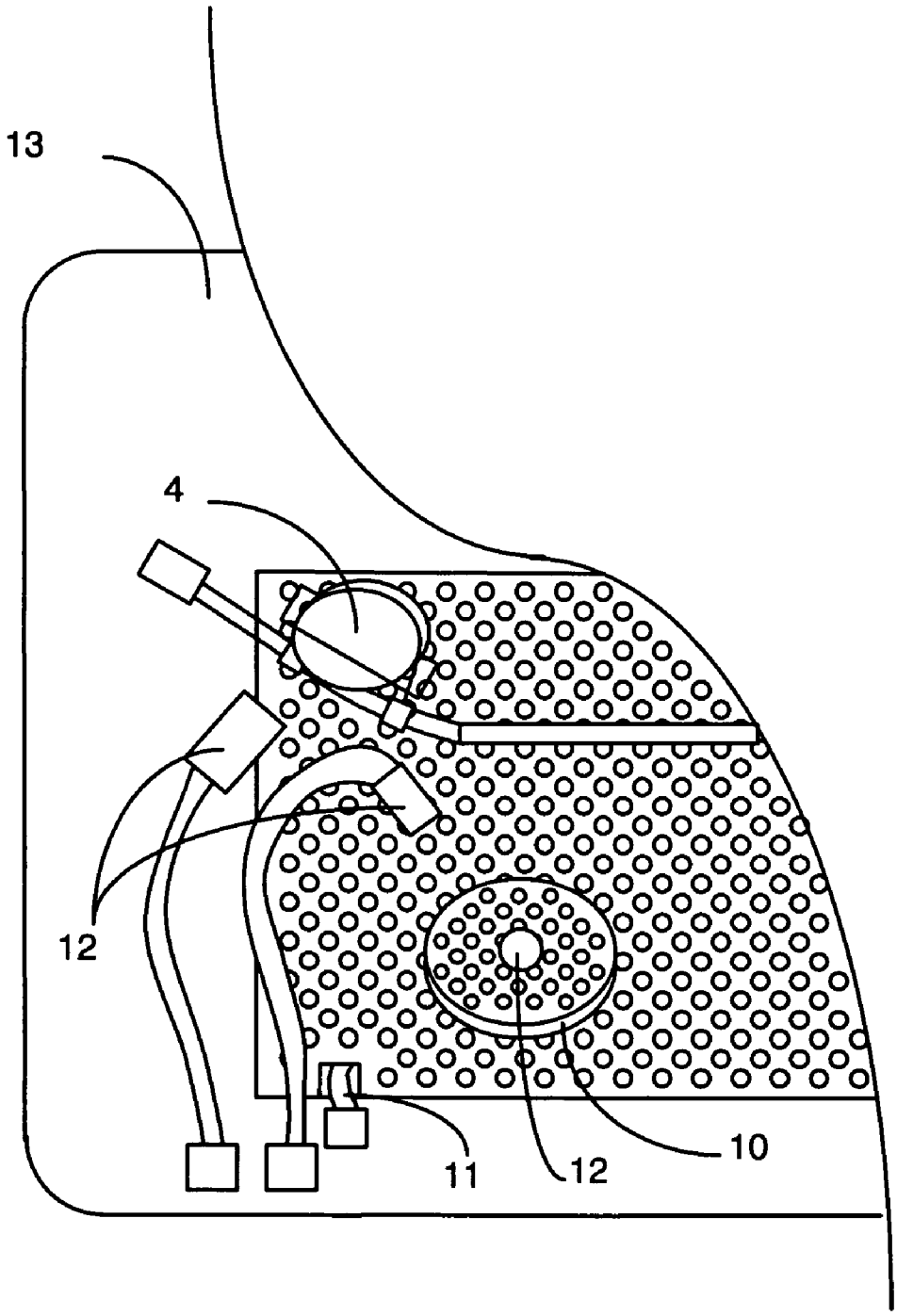
FIG. 8 illustrates the holding device used to hold the paint canister during the cleaning process.

FIG. 8 illustrates the holding device 10 which is designed to hold the paint canister 3. Also shown in this figure are nozzles 12 and fluid extension tubes 11.

Figure 9:
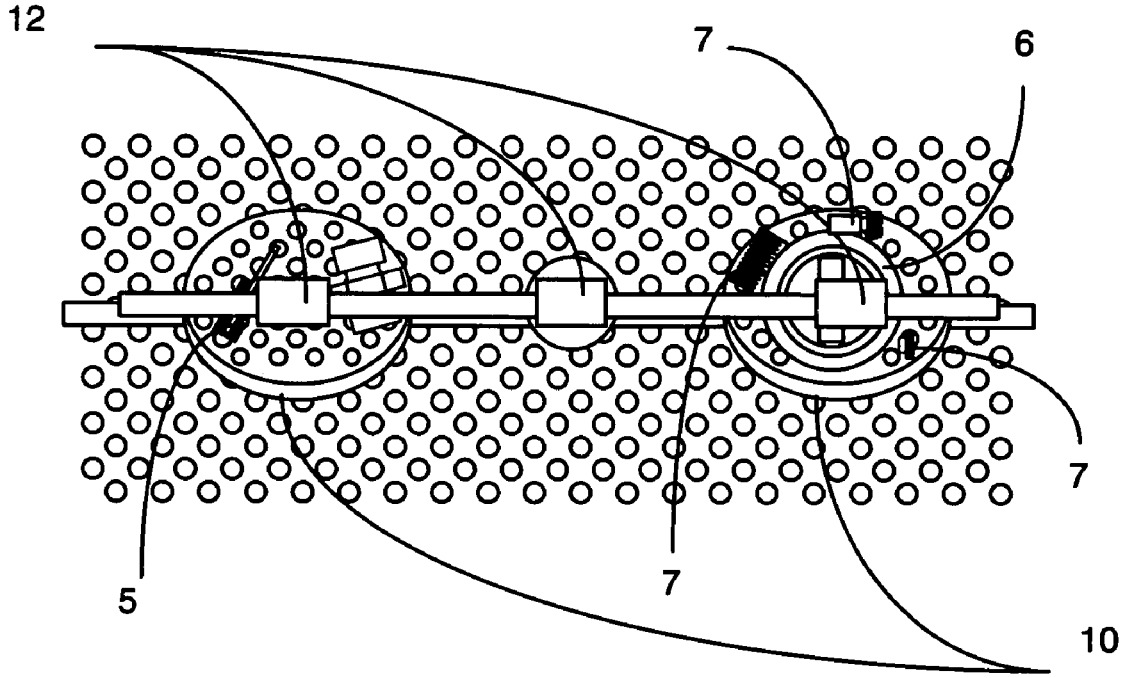
FIG. 9 illustrates the holding devices used to hold smaller components such as the nozzle assembly, the paint filter and the spring while the spring loaded spray adjustment components.

FIG. 9 is a close up view which illustrates how the various components of the nozzle 6, the spring loaded sprayer adjustment components 7, and the paint filter 5 are securely held by the holding devices 10 during the cleaning process. This figure also illustrates the alignment of the nozzles 12 with the components which are to be cleaned.

In addition to using the cleaning fluid to dissolve and remove any residual paint from a paint sprayer once a paint job is completed, the same structure can also be used to accelerate the drying process. In particular, once the cleaning process is complete, the cleaning machine 13 can then pump air through the nozzles 12 to accelerate the drying process.

Figure 10:
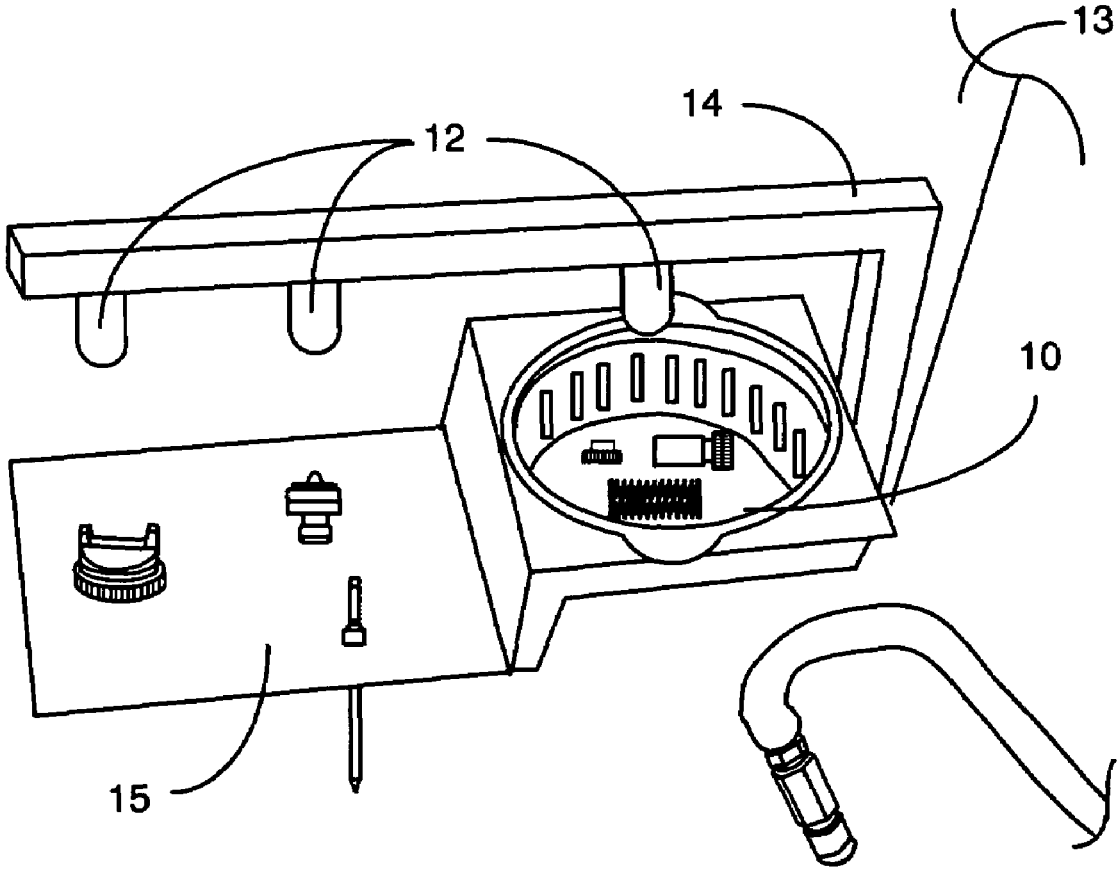
FIG. 10-13 illustrate an alternative preferred embodiment of the invention which uses a plurality of small assemblies to align the cleaning nozzles with their holding devices. A plurality of assemblies allows the use of a single kit for a variety of cleaning machine sizes.

FIG. 10 illustrates an alternative preferred embodiment in which the components of cleaning system are broken into a plurality of smaller cleaning assemblies which are mounted within a conventional cleaning machine 13. In FIGS. 10-13, the extension tubes are attached directly to brackets of the manifold of a conventional cleaning machine 13. In this figure, a first bracket 14 is attached to a fluid extension 11 which supplies multiple cleaning nozzles 12 with cleaning solvent. The first bracket 14 is also attached to a first holding platform 15 which is configured to hold specific components of the paint sprayer along with other holding devices 10. A holding device 10 is shown mounted on the first holding platform 15 along with other components of the paint sprayer. Not visible in this figure are cleaning nozzles 12 located below components resting on first bracket 14 which are designed to clean the bottom side of those components.

An advantage of using a plurality of cleaning assemblies is that the components of the invention are no longer dependent on the particular physical size of the cleaning machine 13. They can now be installed in cleaning machines of any particular physical size or shape. Of course, those skilled in the art will recognize that the shape of the first bracket 14 in the first holding device 15 are for illustrative purposes only. Further, the shapes in configurations illustrated throughout this specification are designed only to illustrate how the device could be used in conjunction with the paint sprayer. In the event that non-paint sprayer devices requiring this type of cleaning operation are used, then the shapes and sizes of bracket and holding devices can vary to suit the particular device being cleaned. By using a plurality of cleaning assemblies, the invention can also be implemented as a retrofit kit which can be used on any size of preexisting cleaning machine 13.

Figure 11:
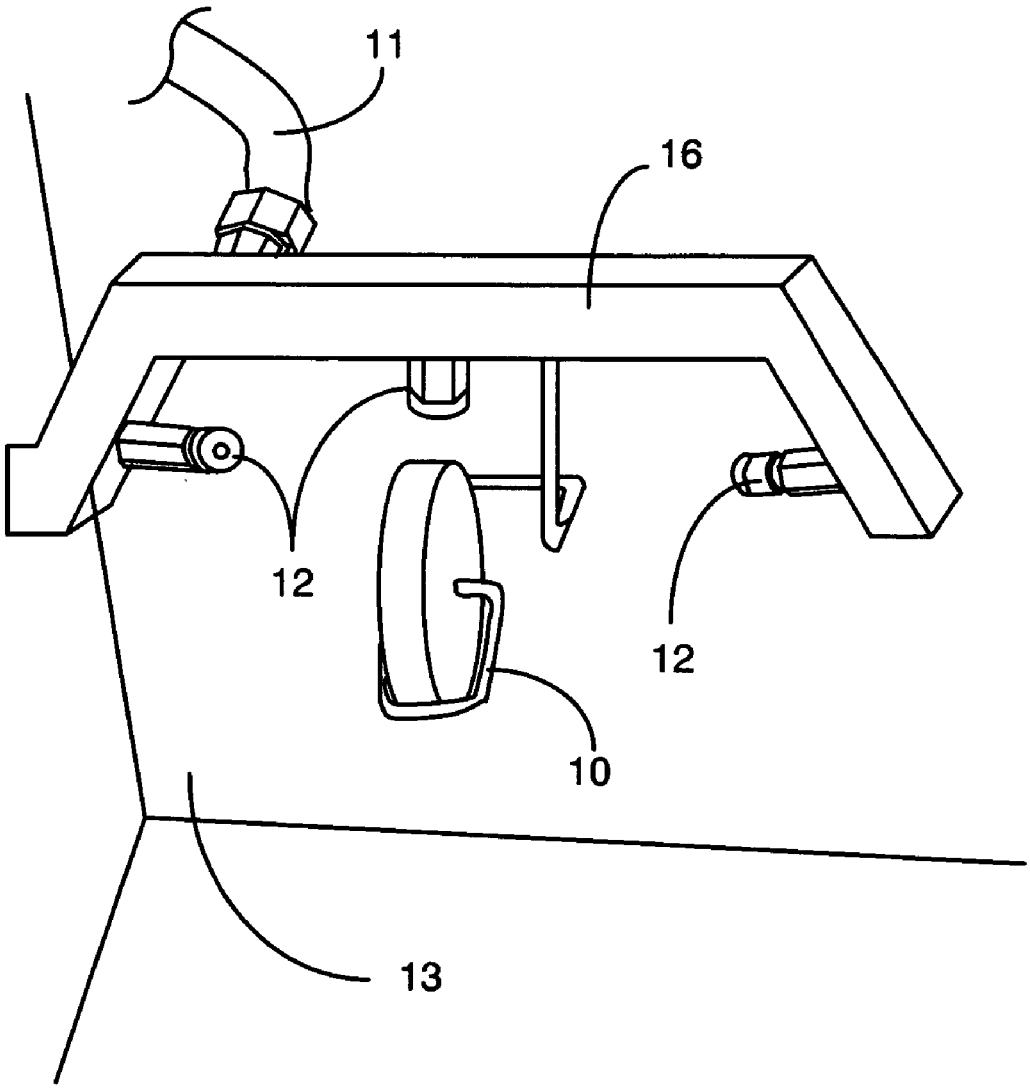

FIG. 11 illustrates the second bracket 16 used in conjunction with a holding device 10. The second bracket 16 is also supplied with solvent via an extension tubes 11 which distributes the solvent to multiple cleaning nozzles 12. As was the case with the components discussed above, in regard to FIG. 10, the use of the smaller second bracket 16 allows the device to be used with any sized cleaning machine 13.

Figure 12:
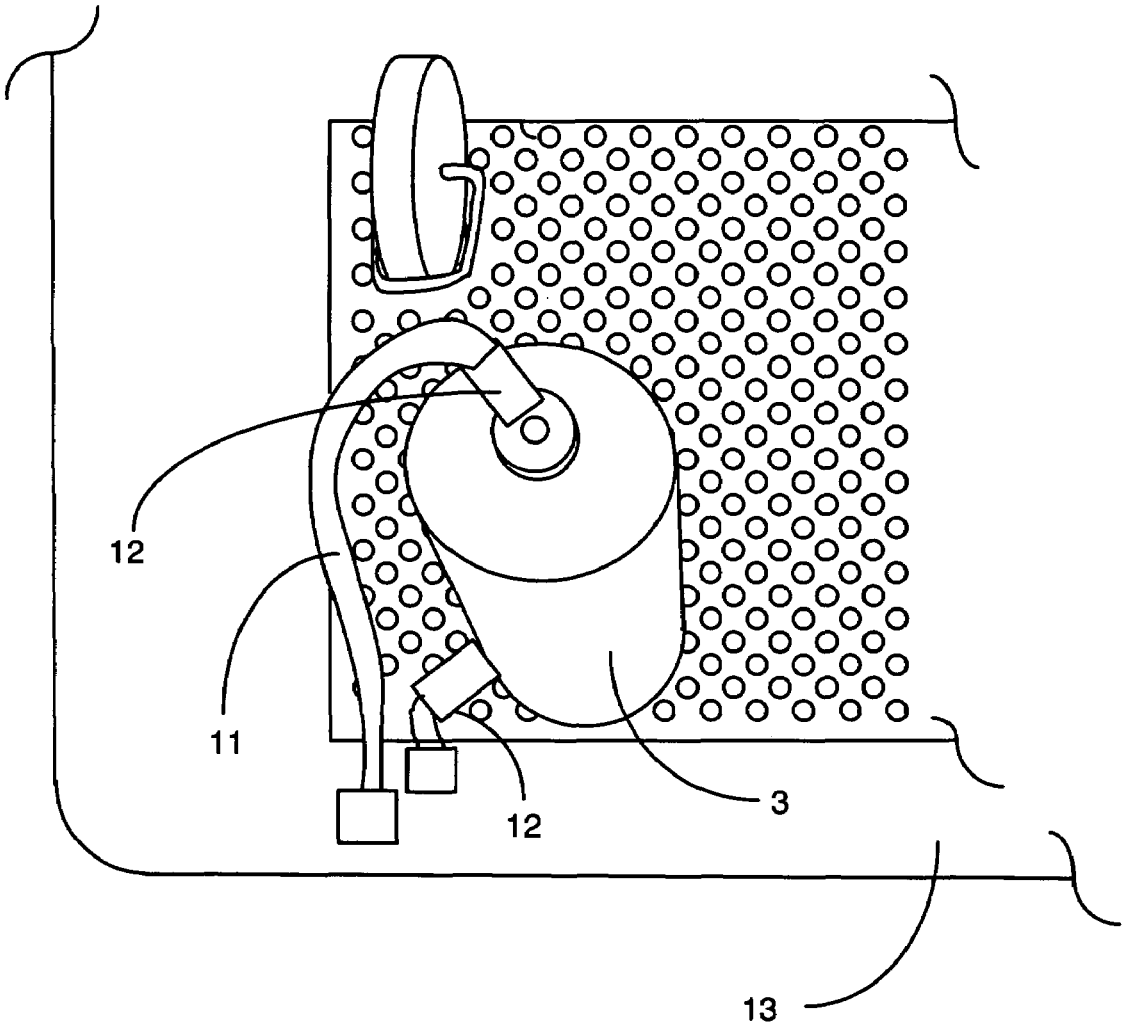

In FIG. 12, the paint sprayer canister 3 is shown mounted in the cleaning machine 13. They cleaning nozzle 12 is attached to an extension tube 11 and shown aligned with the aperture in the cleaning canister 3.

Figure 13:
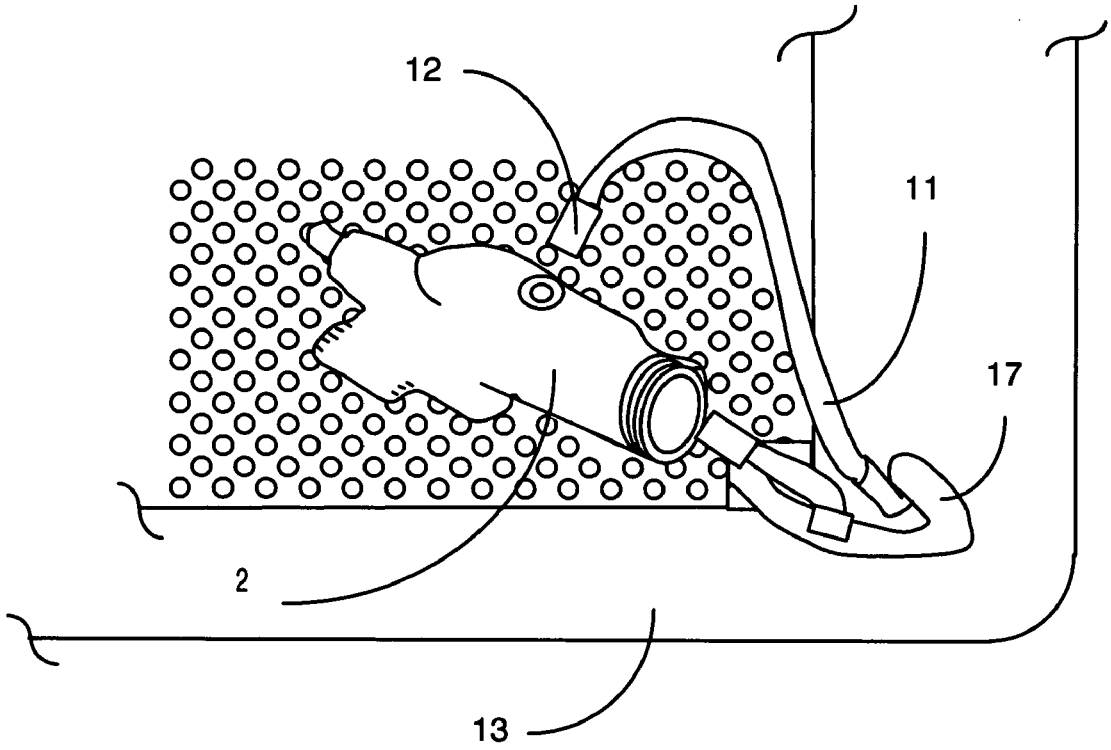

FIG. 13 illustrates a paint sprayer body 2 attached over a holding device 10 (not shown) on a third bracket 17 which is attached to the cleaning machine 13. The bracket assemblies 17 has cleaning nozzles 12, one of which is attached via an extension tube 11, which are aligned with apertures in the paint sprayer body 2. By aligning the cleaning nozzles in this manner, access to the interior of the paint sprayer body 2 by the cleaning solvent is ensured.

As can be seen from the foregoing, the invention provides a semi automated process for cleaning paint sprayers which results in a more thorough and complete cleaning due to the automatic alignment of the sprayer components with the cleaning nozzles. In addition, the invention also reduces the amount of time that the user has to spend directly involved in the cleaning process. Prior to the invention, a user would spend a significant amount of time, after the cleaning machine 13 completed its cycle, examining each component and then re-cleaning the components which were not properly cleaned the first time. The various embodiments also showed that the invention can be customized as part of a cleaning machine 13, or alternatively, it can be constructed to as a plurality of smaller components which can be made part of the cleaning machine 13 or retrofit to preexisting cleaning machines 13. In addition, while a paint sprayer was used to illustrate the benefits of the invention, especially its ability to align cleaning nozzles with apertures in a device containing internal channels which need to be cleaned, those skilled in the art will recognize that the features and advantages of this invention can be used in conjunction with cleaning systems designed to clean any type of device.

Those skilled in the art will recognize that while the invention was discussed in conjunction with a conventional cleaning machine 13, the features and advantages of the invention can also be implemented in conjunction with an ordinary basin by merely attaching a solvent supply line to conduits attached to the cleaning nozzles 12 so that they are supplied with solvent. This allows the invention to be implemented on any container, even those which are not equipped with corner mounted nozzles as is done with prior art cleaning machines 13. Likewise, any of the fittings and connections used for illustrative purposes herein can be interchanged with any other suitable fitting or connection so long as they are suitable for securing and cleaning the components of the particular device being cleaned. Further, while the invention has been discussed in terms of particular holding devices, they can be replaced with anything suitable for holding an object which is to be cleaned, any suitable cleaning nozzle 12 or extension tube 11 can be used, and invention components can be located in any convenient part of the cleaning machine 13.

While the invention has been described with respect to a preferred embodiment thereof, it will be understood by those skilled in the art that various changes in detail may be made therein without departing from the spirit, scope, and teaching of the invention. For example, the extension tubes may be fabricated from any suitable material, the size and shape of the cleaning chamber may vary, the type of solvent can very, etc. Accordingly, the invention herein disclosed is to be limited only as specified in the following claims.

I claim:

1. An apparatus for simultaneously cleaning the exterior surface, individual components, and surfaces of internal channels of an object having a body portion with an internal channel and a plurality of component parts attached to the body portion, comprising;

a basin having sufficient size to hold a disassembled object for cleaning, the basin having a plurality of cleaning nozzles for simultaneously spraying cleaning fluids at the disassembled object;

a plurality of holding devices for holding the disassembled object to be cleaned, at least a first holding device used to hold the body portion of the disassembled object and at least a second holding device to hold one or more component parts of the object which have been detached from the body portion of the object; and a first extension tube providing a path for cleaning fluid, the first extension tube further having a plurality of cleaning nozzles, which are supported by the first extension tube and supplied with cleaning fluid by the first extension tube, and at least a first cleaning nozzle aligned with the holding device that holds the body portion of the object such that cleaning fluids sprayed from the first cleaning nozzle are directed to an aperture in the body portion of the object such that an internal channel in the object is flushed with cleaning fluids;

a second extension tube providing a path for cleaning fluid, the second extension tube further having a plurality of second cleaning nozzles, which are supported by the second extension tube and supplied with cleaning fluid by the second extension tube, and aligned with the second holding devices which hold the component parts of the object which have been detached from the body portion of the object such that cleaning fluids sprayed from the second cleaning nozzles will simultaneously clean the detached component parts of the object while the body portion of the object is being cleaned by the first cleaning nozzle;

whereby individual objects are disassembled and secured in a plurality of holding devices and aligned with cleaning nozzles such that the body portion of the object and detached component parts of the object can be simultaneously and independently cleaned.

2. An apparatus, as in claim 1, wherein:

the first cleaning nozzle is adjustable such that the first cleaning nozzle can clean an object of varying size that is placed in the first holding device.

3. An apparatus, as in claim 2, further comprising:

at least one bracket, attached at one end to a supply of cleaning fluid; and at least a portion of the plurality of the second cleaning nozzles attached to the bracket and aligned with holding devices for holding component parts of an object such that when cleaning fluid is sprayed from the second cleaning nozzles, component parts held by the holding devices are cleaned;

whereby each of the component parts held by holding devices is aligned with a second cleaning nozzle such that the component parts are simultaneously cleaned.

4. An apparatus, as in claim 1, further comprising:

at least one bracket, attached at one end to a supply of cleaning fluid; and at least a portion of the plurality of the second cleaning nozzles attached to the bracket and aligned with holding devices for holding component parts of an object such that when cleaning fluid is sprayed from the second cleaning nozzles, component parts held by the holding devices are cleaned;

whereby each of the component parts held by holding devices is aligned with a second cleaning nozzle such that the component parts are simultaneously cleaned.

5. An apparatus, as in claim 4, wherein:

at least a portion of the second holding devices are designed to hold individual component parts.

6. An apparatus, as in claim 1, wherein:

at least a portion of the second holding devices are designed to hold individual component parts.

7. An apparatus, as in claim 1, wherein:

the first extension tube is attached to a first bracket, and at least a portion of the cleaning nozzles are attached to the first bracket instead of the first extension tube;

the second extension tube is attached to a second bracket, and at least a portion of the second cleaning nozzles are attached to the second bracket instead of the second extension tube;

one or more holding platforms or holding devices attached to the first and/or second brackets and aligned with the cleaning nozzles and the second cleaning nozzles such that individual component parts held by the holding platforms or holding devices are cleaned when cleaning fluid is sprayed from the cleaning nozzles.

8. A kit for attachment to a cleaning basin, comprising:

a plurality of holding devices for holding an object to be cleaned, at least a first holding device for holding a body portion of the object, and at least a second holding device for holding a plurality of component parts detached from the body portion of the object; and a first extension tube providing a path for solvents, the first extension tube further having a plurality of cleaning nozzles, which are supported by the first extension tube and supplied with solvents by the first extension tube, and at least a first cleaning nozzle attached to a supply of solvent, and associated with the body portion of the object, such that solvents sprayed from the cleaning nozzle are directed toward an aperture in the body portion of the object and solvents are sprayed into the aperture and through an internal channel in the body portion of the object such that the internal channel is flushed with cleaning fluids;

a plurality of second cleaning nozzles aligned with the holding devices which hold the component parts of the object which have been detached from the body portion of the object such that cleaning fluids sprayed from the second cleaning nozzles will simultaneously clean the detached component parts of the object while the body portion of the object is being cleaned by the first cleaning nozzle;

whereby the body portion of the object and the detached component parts of the object can be simultaneously and independently cleaned.

9. A kit, as in claim 8, wherein:

a first cleaning nozzle is adjustably aligned with a selected holding device such that cleaning fluid can be directed into an internal channel of the object such that residue can be cleaned from the internal channel in the object.

10. A kit, as in claim 9, wherein:

the first cleaning nozzle is attached to an extension tube having sufficient flexibility to allow the first cleaning nozzle's position to be adjusted in relation to the first holding device;

whereby objects having different sizes or shapes may be placed in selected holding devices, and the nozzle can be moved to accommodate of varying size of objects.

11. An apparatus, as in claim 10, further comprising:

at least one bracket, attached at one end to a supply of cleaning fluid; and at least a portion of the plurality of the second cleaning nozzles attached to the bracket and aligned with holding devices for holding component parts of an object such that when cleaning fluid is sprayed from the second cleaning nozzles, component parts held by the holding devices are cleaned;

whereby each of the component parts held by holding devices is aligned with a second cleaning nozzle such that the component parts are simultaneously cleaned.

12. A kit, as in claim 8, further comprising:

at least one bracket, each bracket operatively connected to a solvent or cleaning fluid supply, and further providing a path for solvents or cleaning fluids to at least one second cleaning nozzle; and each bracket attached to the basin such that it is independently positionable from other brackets;

whereby the brackets can be independently attached to a cleaning basin.

13. A kit, as in claim 12, wherein:

each second cleaning nozzle is movable;

whereby the direction of spray of cleaning fluid can be altered by moving the second cleaning nozzles.

14. An apparatus, as in claim 13, further comprising:

at least one bracket, attached at one end to a supply of cleaning fluid; and at least a portion of the plurality of the second cleaning nozzles attached to the bracket and aligned with holding devices for holding component parts of an object such that when cleaning fluid is sprayed from the second cleaning nozzles, component parts held by the holding devices are cleaned;

whereby each of the component parts held by holding devices is aligned with a second cleaning nozzle such that the component parts are simultaneously cleaned.

15. An apparatus, as in claim 13, wherein:

at least a portion of the second holding devices are designed to hold individual component parts.

16. An apparatus, as in claim 12, further comprising:

at least one bracket, attached at one end to a supply of cleaning fluid; and at least a portion of the plurality of the second cleaning nozzles attached to the bracket and aligned with holding devices for holding component parts of an object such that when cleaning fluid is sprayed from the second cleaning nozzles, component parts held by the holding devices are cleaned;

whereby each of the component parts held by holding devices is aligned with a second cleaning nozzle such that the component parts are simultaneously cleaned.

17. An apparatus, as in claim 16, wherein:

at least a portion of the second holding devices are designed to hold individual component parts.

18. An apparatus, as in claim 8, further comprising:

at least one bracket, attached at one end to a supply of cleaning fluid; and at least a portion of the plurality of the second cleaning nozzles attached to the bracket and aligned with holding devices for holding component parts of an object such that when cleaning fluid is sprayed from the second cleaning nozzles, component parts held by the holding devices are cleaned;

whereby each of the component parts held by holding devices is aligned with a second cleaning nozzle such that the component parts are simultaneously cleaned.

19. An apparatus, as in claim 8, wherein;

the first extension tube is attached to a first bracket, and at least a portion of the cleaning nozzles are attached to the first bracket instead of the first extension tube;

the second extension tube is attached to a second bracket and at least a portion of the second cleaning nozzles we attached to the second bracket instead of the second extension tube;

one or more holding platforms or holding devices attached to the first and/or second brackets and aligned with the cleaning nozzles and the second cleaning nozzles such that individual component parts held by the holding platforms or holding devices are cleaned when solvent is sprayed from the cleaning nozzles.

20. An apparatus for simultaneously cleaning the exterior surface, individual components, and surfaces of internal channels of an object having a body portion with an internal channel and a plurality of component parts attached to the body portion, comprising:

one or more manifolds having internal conduits for supplying cleaning fluid;

a plurality of holding platforms or holding devices, attached to one or more of the manifolds, at least a first holding platform or holding device used to hold the body portion of the disassembled object and at least a second holding platform or holding device to hold one or more component parts of the object which have been detached from the body portion of the object; and a plurality of cleaning nozzles attached to the manifold, and supplied with cleaning fluid by the manifold, and at least a first cleaning nozzle aligned with the holding platform or holding device that holds the body portion of the object such that cleaning fluids sprayed from the first cleaning nozzle are directed to an aperture in the body portion of the object such that an internal channel in the object is flushed with cleaning fluids;

a plurality of second cleaning nozzles attached to the manifold, and supplied with cleaning fluid by the manifold, and aligned with the second holding platforms or holding devices which hold the component parts of the object which have been detached from the body portion of the object such that cleaning fluids sprayed from the second cleaning nozzles will simultaneously clean the detached component parts of the object while the body portion of the object is being cleaned by the first cleaning nozzle;

whereby individual objects are disassembled and secured in a plurality of holding devices and aligned with cleaning nozzles such that the body portion of the object and detached component parts of the object can be simultaneously and independently cleaned.

* * * * *